United States Patent [19]

Takamatsu

[11] 3,958,319

[45] May 25, 1976

[54] APPARATUS FOR PRODUCING ELEMENT-FREE GAPS IN A CONTINUOUS FASTENER CHAIN

[75] Inventor: Ikuo Takamatsu, Uozu, Japan

[73] Assignee: Yoshida Kogyo Kabushiki Kaisha, Japan

[22] Filed: Jan. 28, 1975

[21] Appl. No.: 544,892

[30] Foreign Application Priority Data

Jan. 31, 1974 Japan ..... 49-13200

[52] U.S. Cl. ..... 29/410; 29/207.5 D; 29/427; 83/921

[51] Int. Cl.² ..... B21D 53/52

[58] Field of Search ..... 29/410, 408, 427, 207.5 R, 29/207.5 D; 83/921

[56] References Cited

UNITED STATES PATENTS

| | | | |
|---|---|---|---|
| 2,394,197 | 2/1946 | Morin | 83/921 X |
| 3,225,430 | 12/1965 | Fasciano | 83/921 X |
| 3,490,133 | 1/1970 | Glindmeyer et al. | 29/207.5 D X |
| 3,812,573 | 5/1974 | Fukuroi | 29/427 |
| 3,863,323 | 2/1975 | Takamatsu | 29/408 |

*Primary Examiner*—Victor A. DiPalma
*Attorney, Agent, or Firm*—Bucknam and Archer

[57] ABSTRACT

A method and apparatus for producing element-free gaps or spaces in a continuous fastener chain. Means are provided for supporting a series of discrete fastener elements formed by die-casting a metal or injection-molding a plastics material and secured to a tape cord with their coupling heads faced upwardly, severing the fastener elements into halves at the coupling heads towards the cord and removing the severed elements completely from the cord without damage thereto. The severing operation is effected by a vertically movable cutter blade adapted to thrust centrally into the coupling heads toward the cord and is immediately followed by the removing operation wherein a pair of removers are moved downwardly to take the severed elements away from the cord when the supporting means are forced out of holding engagement with the fastener elements.

8 Claims, 7 Drawing Figures

APPARATUS FOR PRODUCING ELEMENT-FREE GAPS IN A CONTINUOUS FASTENER CHAIN

BACKGROUND OF THE INVENTION

This invention relates to a method and apparatus for producing element-free gaps or spaces in a continuous fastener chain consisting of a carrier tape carrying along its one longitudinal edge a series of discrete fastener elements which are formed by die-casting a metal or injection-molding a plastics material peripherally around a cord reinforcing the tape edge.

There have heretofore been proposed various methods and related apparatuses for the production of fastener element-free gaps in a continuous fastener chain of the type described. One of the methods known in the art is concerned with cutting coupling heads only off the fastener chain for a length corresponding to a desired gap to be formed, and thereafter removing the leg portions left in gripping engagement with the tape cord off the tape. Another method comprises the steps of pressing fastener elements into deformed, flattened configuration for a gap length as desired, and forcibly separating the deformed elements from the tape cord.

However, these prior art methods and related apparatuses have suffered from the drawback that the leg portions remaining on the tape cord or the deformed fastener elements were sometimes held in firm gripping engagement with the tape edge, with the result that the leg portions or deformed elements were difficult to be completely removed from the tape edge without damage thereto.

SUMMARY OF THE INVENTION

With the above-noted drawback of the prior art in view, the principal object of this invention is to provide an improved method of producing element-free gaps in a continuous fastener chain, which method will permit fastener elements secured along the carrier tape edge to be easily severed to produce gaps of desired length without damage to the carrier tape.

Another object of the invention is to provide an apparatus designed to put the above-described method into practice, which apparatus is simple in construction, highly dependable in operation, and durable in use.

These and other objects and features of the invention will be more apparent from the following detailed description of a preferred embodiment taken in conjunction with the accompanying drawings in which like reference characters or numerals refer to like or corresponding parts throughout the several views.

DESCRIPTION OF THE PREFERRED EMBODIMENT

Figure 1:
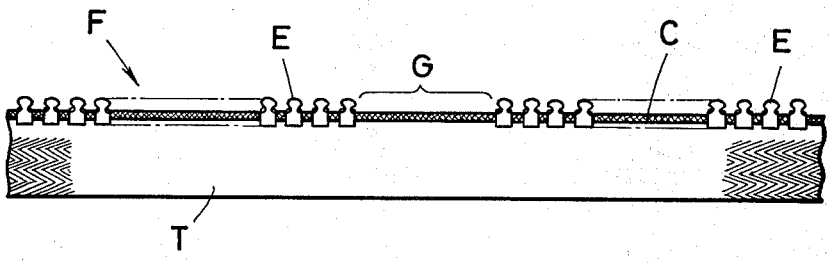
FIG. 1 is a fragmentary plan view of a carrier tape carrying along its one longitudinal edge discrete fastener elements with a series of spaced element-free gaps fromed there-along.

Referring now to the drawings and FIG. 1 in particular, there is shown a continuous fastener chain F comprising a carrier tape T carrying along its one longitudinal edge discrete fastener elements E which are formed by die-casting a metal or injection-molding a plastics material. The longitudinal tape edge is reinforced with a cord C about which the elements E are mounted in firm gripping engagement therewith. Designated at G is an element-free gap as produced by the method and apparatus according to this invention, as hereinafter described in detail.

Figure 2:
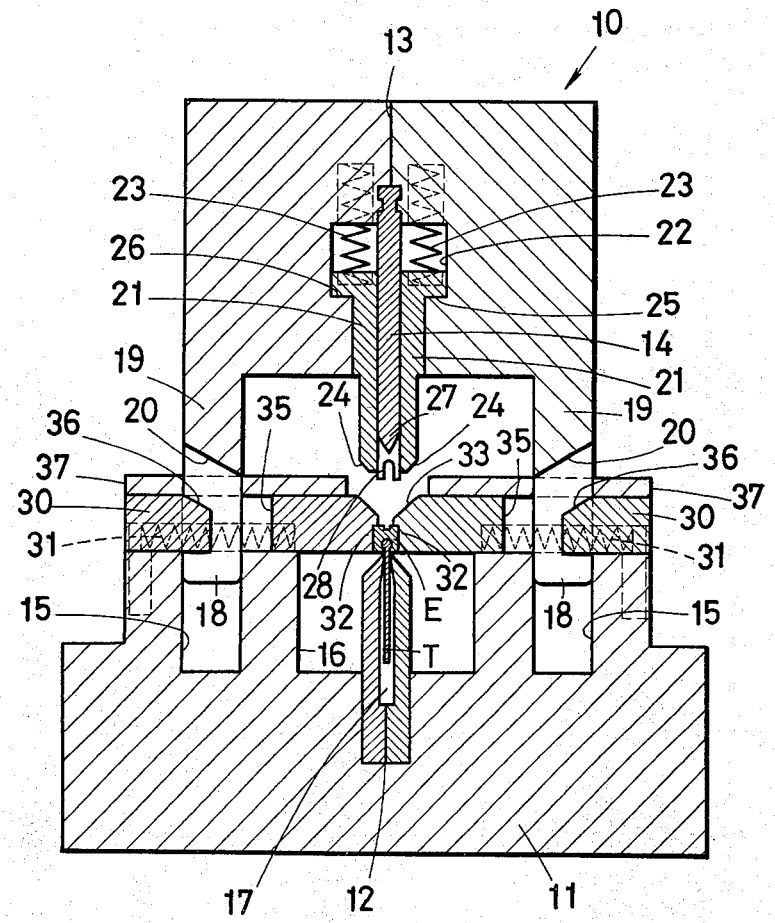
FIG. 2 is a vertical cross sectional view of a gap producing apparatus according to the invention.
Figure 3:
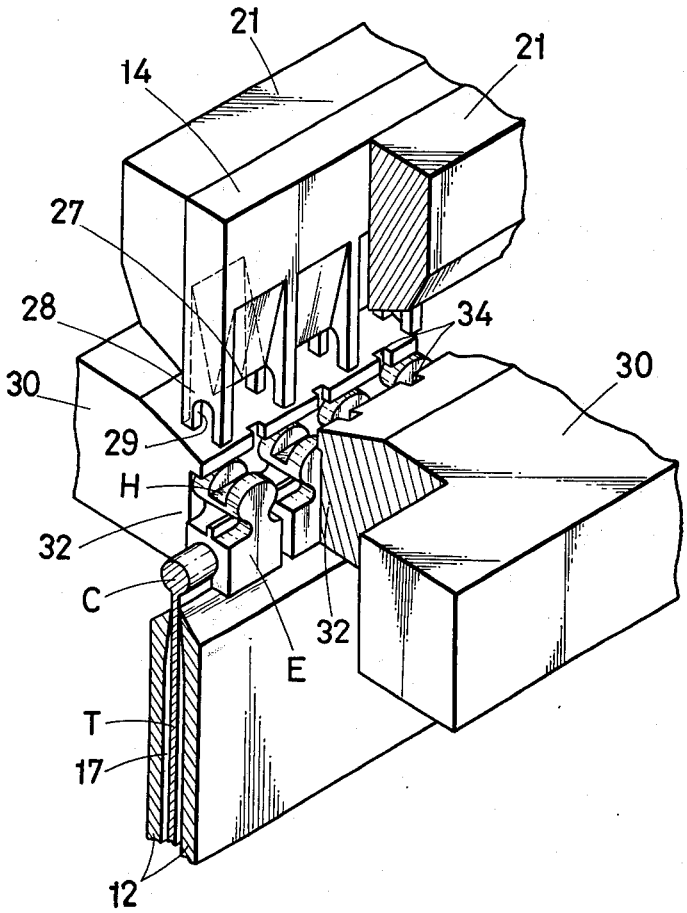
FIG. 3 is a fragmentary perspective view with parts broken away of the apparatus as shown in FIG. 2.

Referring to FIGS. 2 and 3, generally designated at 10 is a preferred embodiment of a gap producing apparatus of this invention which comprises a bed 11, a fastener chain support 12 fixed to the bed 11, a punch holding block 13 disposed in opposed relationship with and vertically reciprocable toward and away from the bed 11, and a blade-shaped punch 14 fixed to and projecting downwardly from the block 13 in vertical registry with the fastener chain support 12. The bed 11 is formed at its lateral sides with a pair of upwardly opening guideways 15 adapted to slidably receive therein a pair of guide members later described. Formed centrally in the bed 11 is a scrap receiving chamber 16 within which is located the fastener chain support 12 projecting upwardly from the bottom of the chamber 16 and terminating at the level of the upper surface of the bed 11. The fastener chain support 12 is provided therein with a slot 17 having its upper end open for accommodating the carrier tape T and is tapered at its top portion for gripping engagement with the fastener chain F directly beneath the fastener elements E. Thus, the fastener chain F is held in place by the support 12 such that the elements E surrounding the cord C rest on the top end of the support 12 with the tape T accommodated in the slot 17 and with the coupling heads H (FIG. 4) of the elements E facing toward a cutter blade later described.

The punch holding block 13 is provided at its lateral sides with a pair of guide members 18 projecting downwardly therefrom and adapted to slidably telescope within the guideways 15 of the bed 11 for guiding the upward and downward movement of the punch holding block 13. The guide members 18 are provided with cam members 19 which are formed at their lower ends of outwardly inclined cam surfaces 20 for the purposes later described. Provided laterally of the punch 14 are a pair of element removers 21 movable relative thereto and slidably fitted in a cavity 22 defined in the block 13. Housed in the cavity 22 and abutting against the upper ends of the removers 21 are a pair of compression springs 23 which normally bias the removers 21 downwardly.

The removers 21 each have an outwardly inclined surface 24 at its lower end and a transversely protruding member 25 at its upper portion for abutting engagement with a shoulder 26 of the cavity 22 to restrict the downward movement of the remover 21 against the tension of the spring 23.

As best seen in FIG. 3, a plurality of cutter blades 27 are provided at the lower portion of the punch 14 which correspond in dimension and number to the elements E to be severed off from the carrier tape T for forming the element free gap G. Bifurcated spacer arms 28 are formed integrally with the punch 14 and arranged alternately with the blades 27 in the longitudinal direction of the fastener chain F.

The spacer arms 28 which project downwardly from the punch 14 and extend beyond the tips of the blades 27 are formed with cutouts 29 for surrounding engagement with the cord C exposed between adjacent elements E. It is to be noted that the cutouts 29 are spaced apart from the blades 27 by a predetermined distance later explained.

Designated at 30 are a pair of element holders which are horizontally slidable on the bed 11 toward and away from each other in the transverse direction of the fastener chain F and are normally urged inwardly toward each other by compression springs suggested at dotted serrated lines 31, thereby holding the elements E firmly in place between their inner ends 32.

Formed at the upper edges of the holder inner ends 32 are bevels 33 fashioned for face-to-face contact with the inclined surfaces 24 when the removers 21 are lowered. Also formed at the inner ends 32 of the holders 30 are longitudinally spaced-apart recesses 34 arranged in vertical alignment with the spacer arms 28 and adapted to admit them therethrough when the punch 14 is in its lowered position. There are defined in the holders 30 a pair of openings 35 which are adapted to receive the cam members 19 when the holders 30 are moved outwardly or into their retracted position. The openings 35 are provided at their upper edges with bevels 36 configured for face-to-face contact with the cam surfaces 20 when the punch holding block 13 is lowered. Indicated by 37 are cover plates fitted over the element holders 30 for protective purposes.

Figure 4:
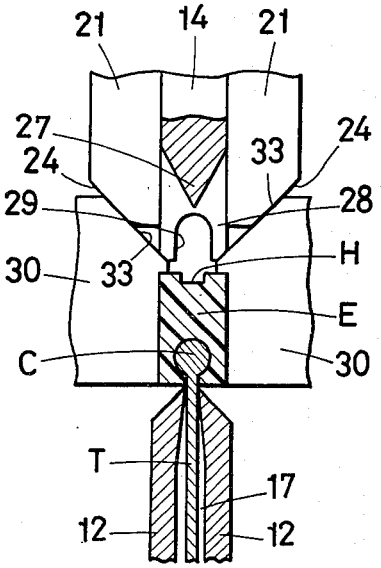
FIG. 4 is a fragmentary vertical cross section on enlarged scale of the important operative parts of the apparatus and showing a row of fastener elements before these are severed off from the carrier tape.
Figure 6:
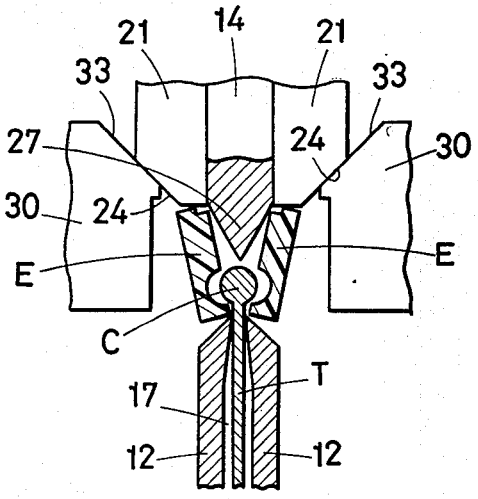
FIG. 6 is a similar view but showing the elements being severed off.
Figure 5:
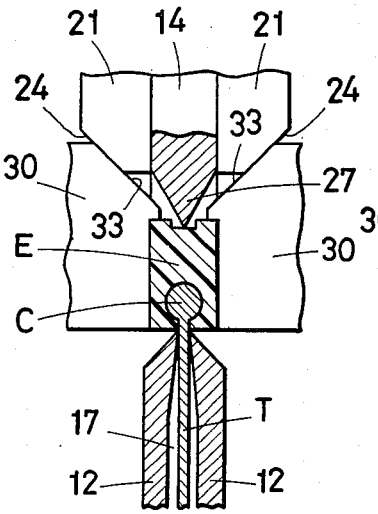
FIG. 5 is a similar view but showing an initial stage of the element severance operation.
Figure 7:
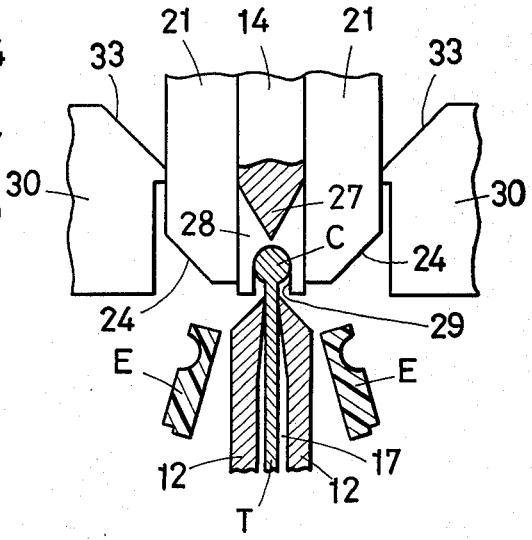
FIG. 7 is a similar view but showing the elements after they have completely been severed off the tape.

Now, the mode of operation of the gap producing apparatus 10 thus constructed will be hereinafter described with particular reference to FIGS. 4 to 7 wherein the sequential steps of gap production are illustrated. As seen in FIG. 4, the element E supported on the fastener chain support 12 is held in place in sandwiched relation to the spring-loaded element holders 30 with the coupling head H faced upwardly in vertical registry with the path of the blade-shaped punch 14. As the punch holding block 13 descends, the punch 14 and the mating spring-loaded removers 21 are lowered together until the inclined surfaces 24 of the removers 21 are brought into face-to-face contact with the bevels 33 of the element holders 30. Upon the face-to-face contact with the bevels 33, the removers 21 are prevented from excess downward movement against the tension of the compression spring 23 because the element holders 30 are in their innermost position. During which time, the punch 14 continues to descend with the block 13 until the blade 27 begins to thrust into the coupling heads H to remove the coupling elements E. Accordingly, a length of elements E is severed centrally into two identical parts along a longitudinal plane extending centrally from the coupling head H to the cord C as shown in FIG. 6. Concurrent with this, the outwardly inclined cam surfaces 20 of the cam members 19 are driven into face-to-face engagement with the bevels 35 of the element holders 30 and their continued downward movement urges the holders 30 to move outwardly, or retract them away from each other. Thus, the removers 21 are allowed to again move downwardly with the inclined surfaces 24 sliding on the bevels 33, as depicted in FIG. 6. The punch 14 is then brought to a stop as the cutouts 29 engage peripherally with the cord C. FIG. 7. shows the final step of the element severance operation wherein the removers 21 force severed elements E apart from the carrier tape T into the scrap receiving chamber 16 without damage to the tape.

It will be appreciated that because the cutouts 29 are spaced apart from the blade 27, the cord C surrounded by the cutouts 29 does not contact the blade 27 and hence is not damaged thereby in the severance operation. With this element severance operation, the elements are readily cut into halves and completely severed off the fastener chain F in a simple manner without damage to the carrier tape T.

After the complete severance of the element E, the punch 14 and removers 21 are raised upwardly out of engagement with the cord C and element holder 30 respectively, whereupon the holders 30 are urged inwardly toward each other under the influence of the compression springs 31.

In this manner, all operative parts of the gap production apparatus are brought back into their initial position to repeat the gap production operation.

Although a specific embodiment has been illustrated, it is to be understood that the embodiment is by way of example only and modifications may be made therein without departing from the true spirit and scope of the invention.

What is claimed is:

1. An apparatus for producing element-free gaps in a continuous fastener chain having a carrier tape carrying along its one longitudinal edge a series of discrete fastener elements secured to a cord, said apparatus comprising: a bed; first guide means provided at said bed; a fastener chain support fixed to said bed for supporting the fastener chain with coupling heads of the fastener elements faced upwardly; a pair of element holding means horizontally slidable on said bed and normally urged to hold the fastener elements therebetween supported by said fastener chain support; punch holding means disposed in opposed relationship with and vertically reciprocable toward and away from said bed; second guide means provided at said punch holding means for coacting with said first guide means; a punch means fixed to and projecting downwardly from said punch holding means, said punch means being in vertical registry with said fastener chain support and adapted to thrust into the coupling heads toward the cord to sever the fastener elements supported by the fastener chain support; and remover means movably mounted in said punch holding means and adapted to remove the severed elements off from the fastener chain, said remover means cooperating with the vertical movement of said punch holding means in performing the function thereof.

2. An apparatus as defined in claim 1 in which said element holding means are provided with a pair of compression springs to normally urge said means to hold the fastener elements and at their upper surfaces with bevels.

3. An apparatus as defined in claim 2 in which said second guide means are provided with outwardly inclined cam surfaces fashioned for face-to-face contact with said bevels, whereby said element holding means are forced out of holding engagement with the fastener elements when said punch holding means is lowered.

4. An apparatus as defined in claim 1 in which said remover means are provided with a compression spring to normally urge itself downwardly.

5. An apparatus as defined in claim 4 in which said remover means are adapted to descend between the element holding means thereby removing the severed elements off from the fastener chain, when said element holding means are forced out of holding engagement with the fastener elements.

6. An apparatus for producing element-free gaps in a continuous fastener chain having a carrier tape carrying along one longitudinal edge a series of discrete fastener elements secured to a cord; said apparatus comprising a bed; a fastener chain support means on said bed and operable to support a lengthwise portion of the fastener chain with the coupling heads of the fastener elements aligned with respect to a given plane; a pair of element holding means moveable transversely and oppositely relative to said plane and biased for engagement with respective opposite sides of said fastener elements to hold the fastener elements therebetween supported by said fastener chain support means; punch holding means disposed for reciprocal movement in said plane toward and away from said fastener chain support means; a punch means carried by said punch holding means, said punch means including a cutting surface positioned to cut into said coupling heads and toward the cord to sever the fastener elements supported by the fastener chain support, and means engaging said cord to limit the advancement of said cutting surface to avoid cutting into said cord; and remover means carried by said punch holding means and operable in response to the movement thereof to remove the severed elements off from the fastener chain.

7. An apparatus according to claim 6 wherein said fastener chain support includes a pair of support members disposed to receive between them the carrier tape, said support members having end surfaces tapered toward said fastener elements on the fastener chain length portion held by the fastener chain support means.

8. An apparatus according to claim 6 wherein said punch means includes bifurcated spacer arms arranged for insertion between consecutive fastener elements and positioned to prevent cutting of said cord and said cutting surface.

* * * * *